US006705260B2

(12) United States Patent
Lewis et al.

(10) Patent No.: US 6,705,260 B2
(45) Date of Patent: Mar. 16, 2004

(54) REED VALVE VCT PHASER WITH WORM TRAILS

(75) Inventors: Jeffrey H. Lewis, Freeville, NY (US); Robert G. Williamson, Breesport, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/391,328

(22) Filed: Mar. 18, 2003

(65) Prior Publication Data

US 2003/0196627 A1 Oct. 23, 2003

Related U.S. Application Data

(60) Provisional application No. 60/374,599, filed on Apr. 22, 2002.

(51) Int. Cl.[7] ..... F01L 1/34

(52) U.S. Cl. ..... 123/90.17; 123/90.12; 123/90.15; 123/90.27; 137/512.5

(58) Field of Search ..... 123/90.15, 90.16, 123/90.17, 90.27, 90.31, 90.12, 90.13; 464/1, 2, 160; 137/512.15, 512.4, 511, 512

(56) References Cited

U.S. PATENT DOCUMENTS

| | | | | | |
|---|---|---|---|---|---|
| 5,056,477 | A | * | 10/1991 | Linder et al. | 123/90.17 |
| 5,243,934 | A | * | 9/1993 | Boyesen | 123/73 V |
| 5,645,017 | A | * | 7/1997 | Melchior | 123/41.15 |
| 5,797,361 | A | * | 8/1998 | Mikame et al. | 123/90.17 |
| 5,832,887 | A | | 11/1998 | Adachi et al. | 123/90.17 |
| 6,105,543 | A | * | 8/2000 | Ogawa | 123/90.17 |
| 6,374,787 | B2 | | 4/2002 | Simpson et al. | 123/90.17 |
| 6,609,535 | B2 | * | 8/2003 | Oppermann et al. | 137/512.15 |
| 2001/0054404 | A1 | | 12/2001 | Miyasaka et al. | 123/90.17 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

The phaser of the present invention includes a reed plate. The reed plate has reed valves, which control the flow of hydraulic fluid. The reed valves are all inclusive on the reed plate. Worn trails in the surface of the parts sandwiching the reed plate direct the flow to and from the reed valves.

7 Claims, 5 Drawing Sheets

REED VALVE VCT PHASER WITH WORM TRAILS

REFERENCE TO RELATED APPLICATIONS

This application claims an invention which was disclosed in Provisional Application No. 60/374,599, filed Apr. 22, 2002, entitled "WORM TRAIL REED STYLE VCT". The benefit under 35 USC §19(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to a vane-type variable cam timing device employing worm trail reed valves to a flow of hydraulic fluid.

2. Description of Related Art

Engine performance in an engine having one or more camshafts can be improved, specifically in terms of idle quality, fuel economy, reduced emissions, or increased torque, by way of a variable cam timing (VCT) system. For example, the camshaft can be "retarded" for delayed closing of intake valves at idle for stability purposes and at high engine speed for enhanced output.

Likewise, the camshaft can be "advanced" for premature closing of intake valves during mid-range operation to achieve higher volumetric efficiency with correspondingly higher levels of torque. In a dual-camshaft engine, retarding or advancing the camshaft is accomplished by changing the positional relationship of one of the camshafts, usually the camshaft that operates the intake valves of the engine, relative to the other camshaft and the crankshaft. Accordingly, retarding or advancing the camshaft varies the timing of the engine in terms of the operation of the intake valves relative to the exhaust valves, or in terms of the operation of the valves relative to the position of the crankshaft.

Many VCT systems incorporating hydraulics include an oscillatable rotor secured to a camshaft within an enclosed housing, where a chamber is defined between the rotor and housing. The rotor includes vanes mounted outwardly therefrom to divide the chamber into separated first and second fluid chambers. Such a VCT system often includes a fluid supplying configuration to transfer fluid within the housing from one side of a vane to the other, or vice versa, to thereby rotate the rotor with respect to the housing in one direction or the other. Such rotation is effective to advance or retard the position of the camshaft relative to the crankshaft. These VCT systems may either be "self-powered" having a hydraulic system actuated in response to torque pulses flowing through the camshaft, or may be powered directly from oil pressure from an oil pump. Additionally, mechanical connecting devices are included to lock the rotor and housing in either a fully advanced or fully retarded position relative to one another.

Check valves are used to control the oil flow to the fluid chambers in the vanes. FIG. 5 shows a check valve (30) as known in the prior art. A base (31) forms the basic structure of the check valve (30). Seals (37), shown as o-rings in the figure, seal the check valve to prevent it from leaking. A disk (36) is located on the top of the base (31). The disk (36) is pushed up by oil flowing (34) through the base (31). A spring (38) is located above the base. A cap (35) covers the top of the base (31), the disk (36), and the spring (38). Oil can flow

(34) only in one direction, up through the hole (33) at the bottom of the base (31).

The prior art valve is made up of multiple pieces, which makes it expensive to manufacture. Each of the pieces can separately wear out, subjecting it to durability concerns. In addition, the valve opens slowly, since it takes effort to unseat and lift the disk (36).

Therefore, there is a need in the art for a valve system which overcomes the disadvantages of the prior art.

SUMMARY OF THE INVENTION

The phaser of the present invention includes a reed plate. The reed plate has reed valves, which control the flow of hydraulic fluid. The reed valves are all inclusive on the reed plate. Worm trails in the surface of the parts sandwiching the reed plate direct the flow to and from the reed valves.

DETAILED DESCRIPTION OF THE INVENTION

The "phaser" is all of the parts of the engine which allow the camshaft to run independently of the crankshaft.

The present invention overcomes the shortcomings of the prior art check valves. One advantage is that the reed valve does not have to be opened as far to get adequate flow. Since the whole area of the reed valve can open up, it allows for more flow volume. In addition, since the prior art check valves sit on a flat surface, it takes effort to unseat the valve. In contrast, the reed valves of the present invention act like a zipper, and open more easily and quickly. Also, the amount of area available for packaging is increased. Replacing the multiple pieces of the prior art check valves with a single reed plate makes the check valves less expensive.

Figure 1A:
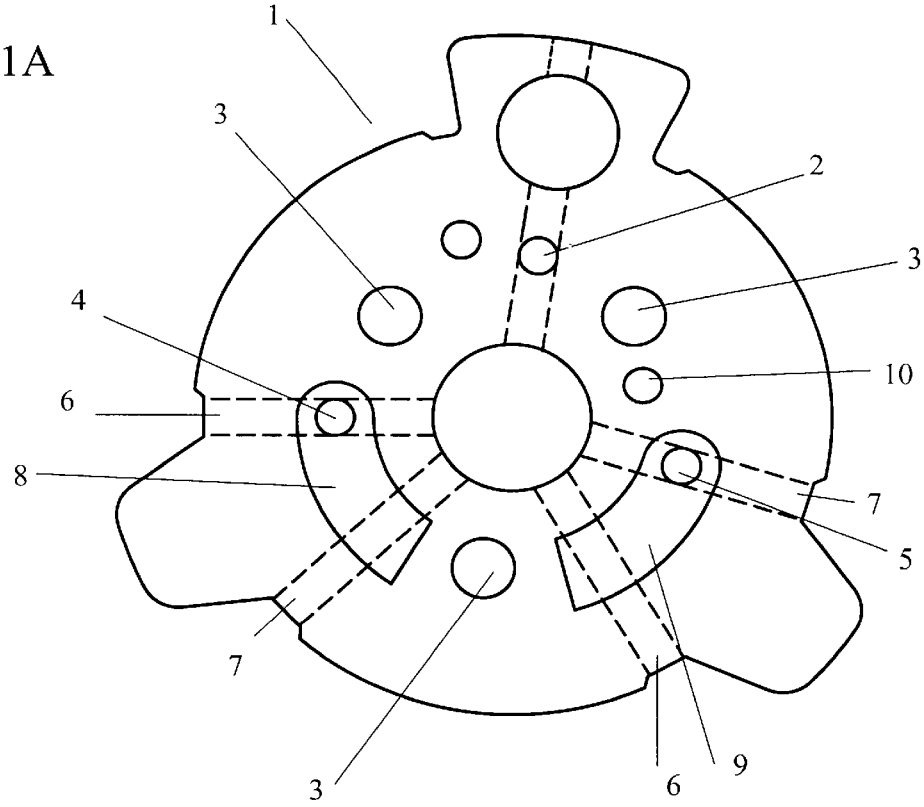
FIG. 1A shows a rotor in an embodiment of the present invention.
Figure 1B:
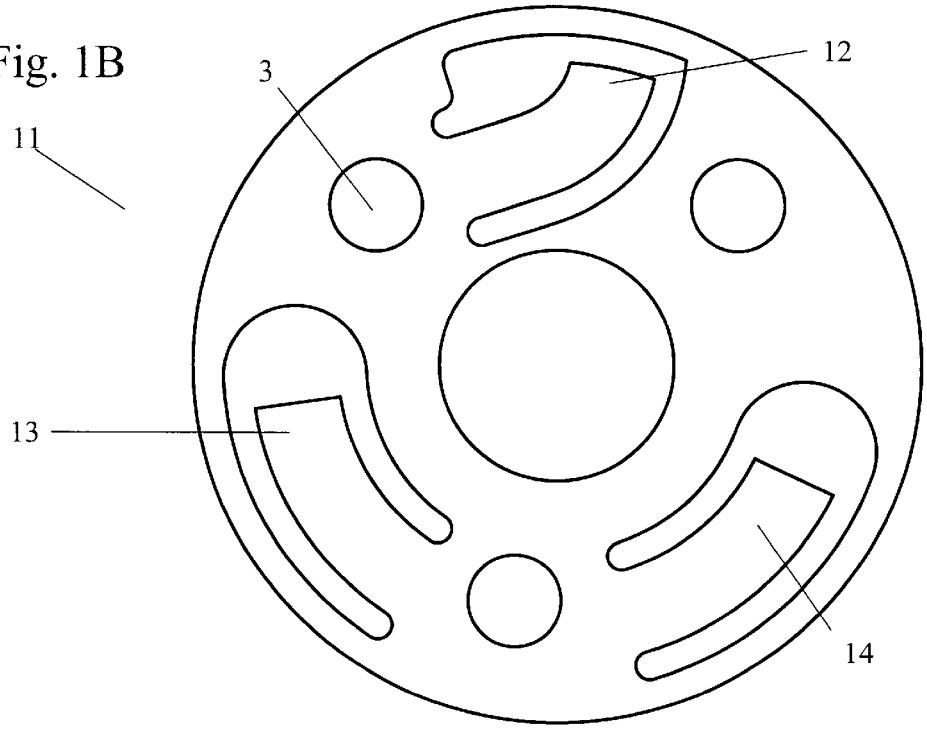
FIG. 1B shows a reed plate in an embodiment of the present invention.
Figure 1C:
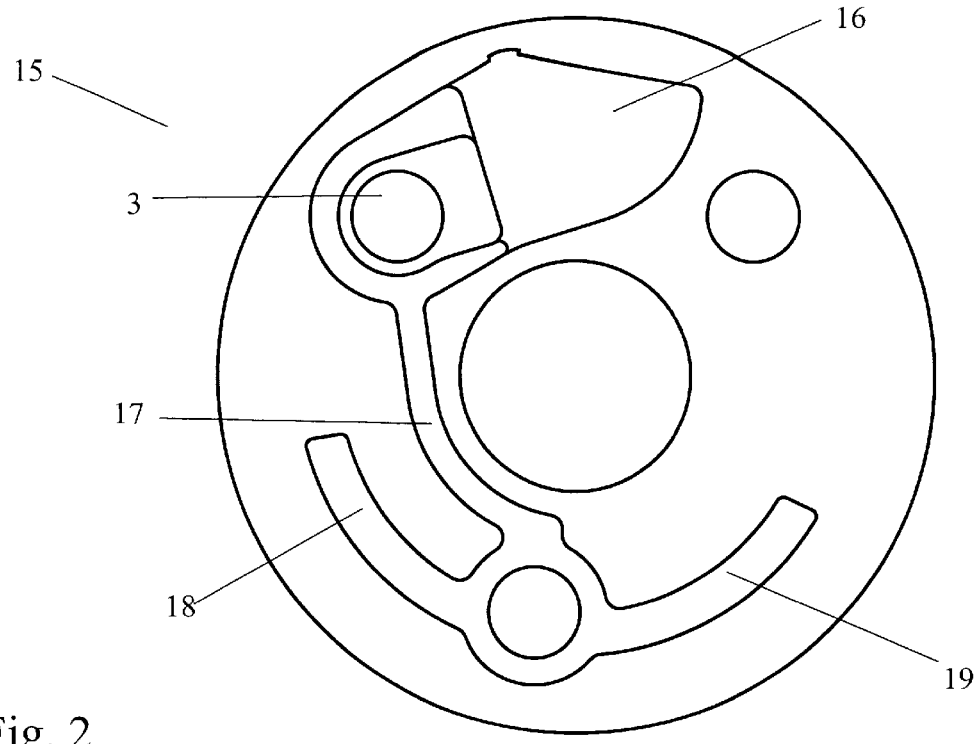
FIG. 1C shows a spacer in an embodiment of the present invention.
Figure 2:
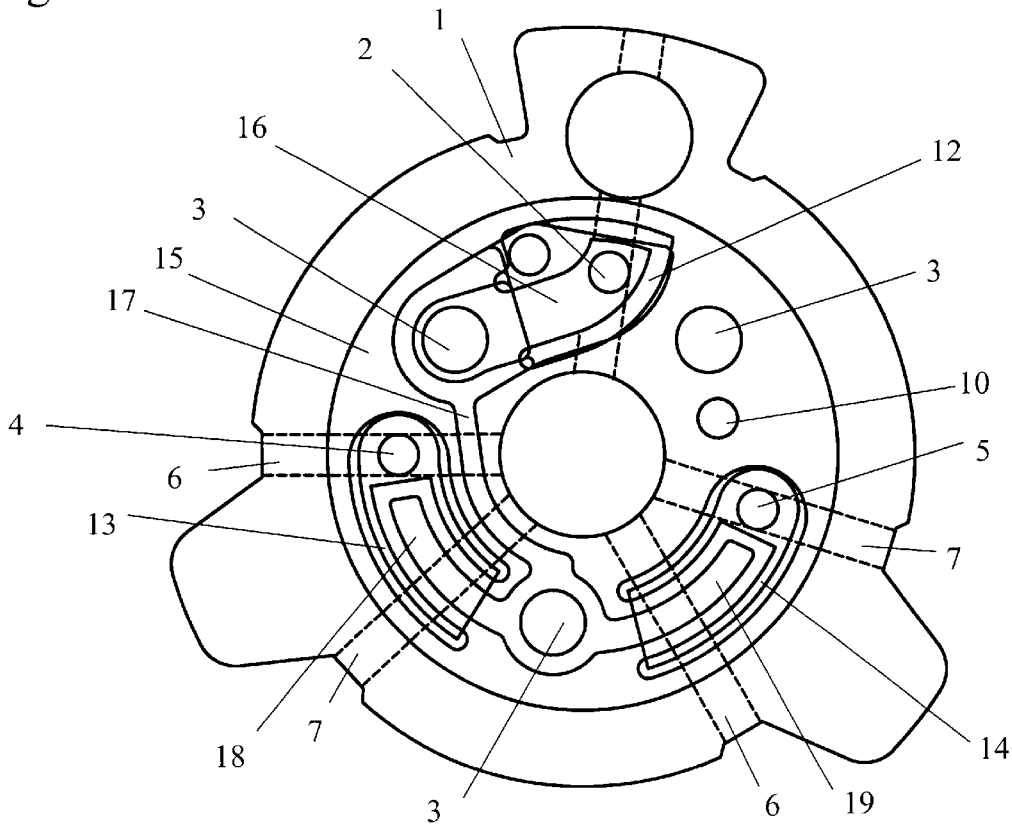
FIG. 2 shows a composite view of the rotor, reed plate, and rotor in an embodiment of the present invention.

FIGS. 1A through 1C show a rotor (1), a reed plate (11) and a spacer (15). These three components are combined to form FIG. 2. As FIG. 2 shows, the spacer (15) is preferably stacked and concentric to the reed plate (11), which is preferably stacked and concentric to the rotor (1) when the device is in use. In a preferred embodiment, the reed plate (11) is approximately 0.3 mm thick. The thickness of the spacer (15) depends on the thickness of the grooves, or worm trails. In a preferred embodiment, the grooves are approximately 4 mm deep, and the spacer is approximately 10–15 mm thick.

Oil comes through the cam shaft into the rotor (1). A make-up oil hole (2) also receives oil from the cam. A hole (4) for phasing provides oil to passageways (6), which lead to a first fluid chamber. A second hole (5) for phasing provides oil to passageways (7), which leads to a second fluid chamber. A pin (10) is preferably located on the rotor (1) to orient the camshaft. The chamber reed valves (13) and (14) are aligned with the recesses (8) and (9). The chamber reed valves (13) and (14) on the reed plate (11) are preferably tabs, or flapper valves, which work as check valves. When the system is pressurized forward, it pushes the chamber reed valves (13) and (14) down. When the system is less pressurized, the chamber reed valves (13) and (14) close. The chamber reed valves (13) and (14) act as check valves for the system. Fasteners, for example bolts (3), preferably fasten the rotor (1), the reed plate (11) and the spacer (15) together.

The spacer (15) includes a cavity (16) where oil is fed through the camshaft, and make-up oil is fed through the hole (2). The oil is fed through a primary worm trail (17) to both of the holes (4) and (5) for phasing. A first secondary worm trail (18) leads to the hole (4), and a second secondary worm trail (19) leads to the hole (5).

The worm trails (17), (18) and (19), or grooves, in the spacer (15) feed the reed chamber valves (13) and (14). When the oil flows through in one direction, one of the valves locks, while the other valve opens, and vice versa. When a chamber becomes pressurized due to inertia, the check valve prevents oil from bleeding out. When movement is warranted, the system is vented to let it go one way or the other.

Figure 3:
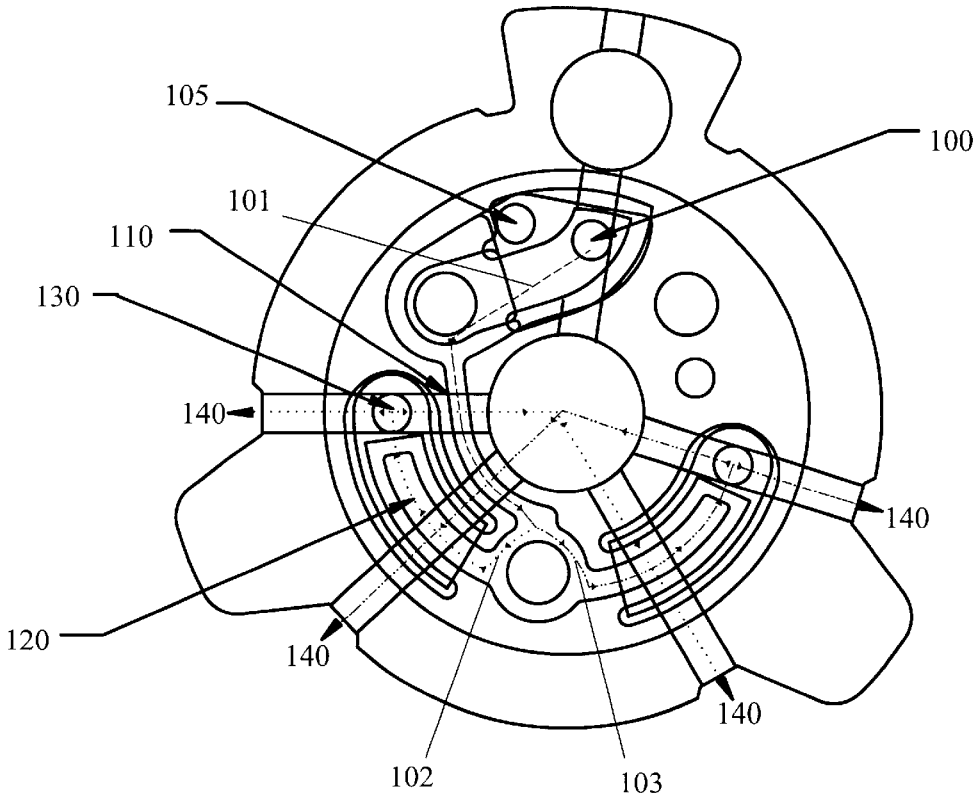
FIG. 3 shows the flow of oil through the device of FIG. 2.
Figure 4:
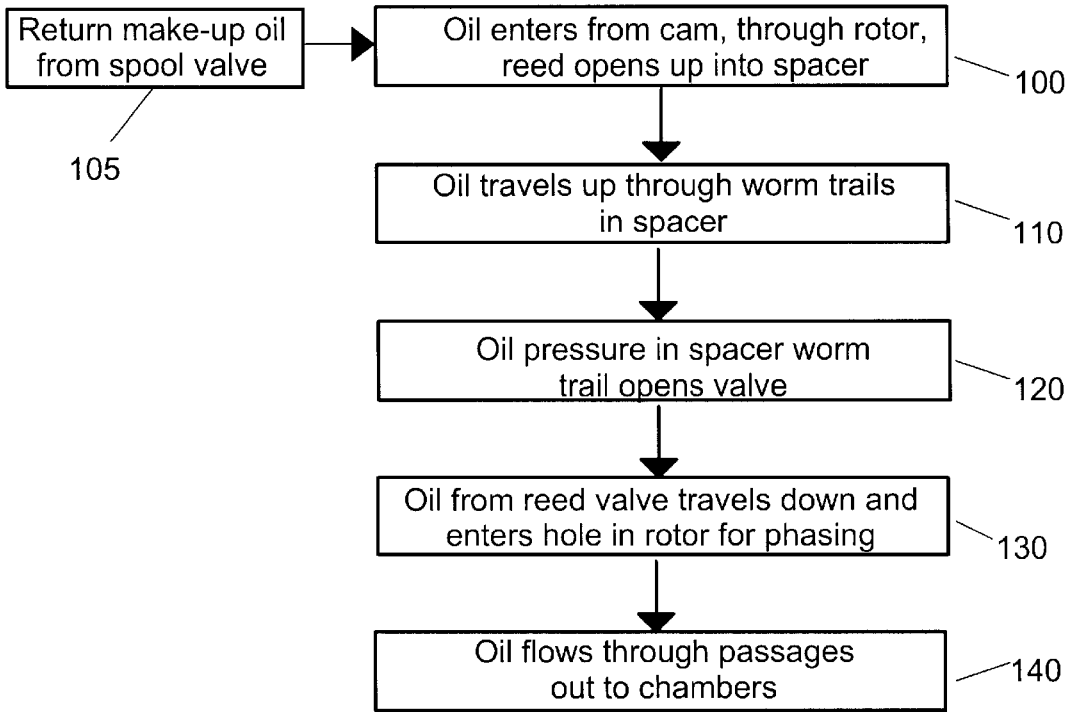
FIG. 4 shows a flowchart of the flow of oil through the device of FIG. 2.
Figure 5:
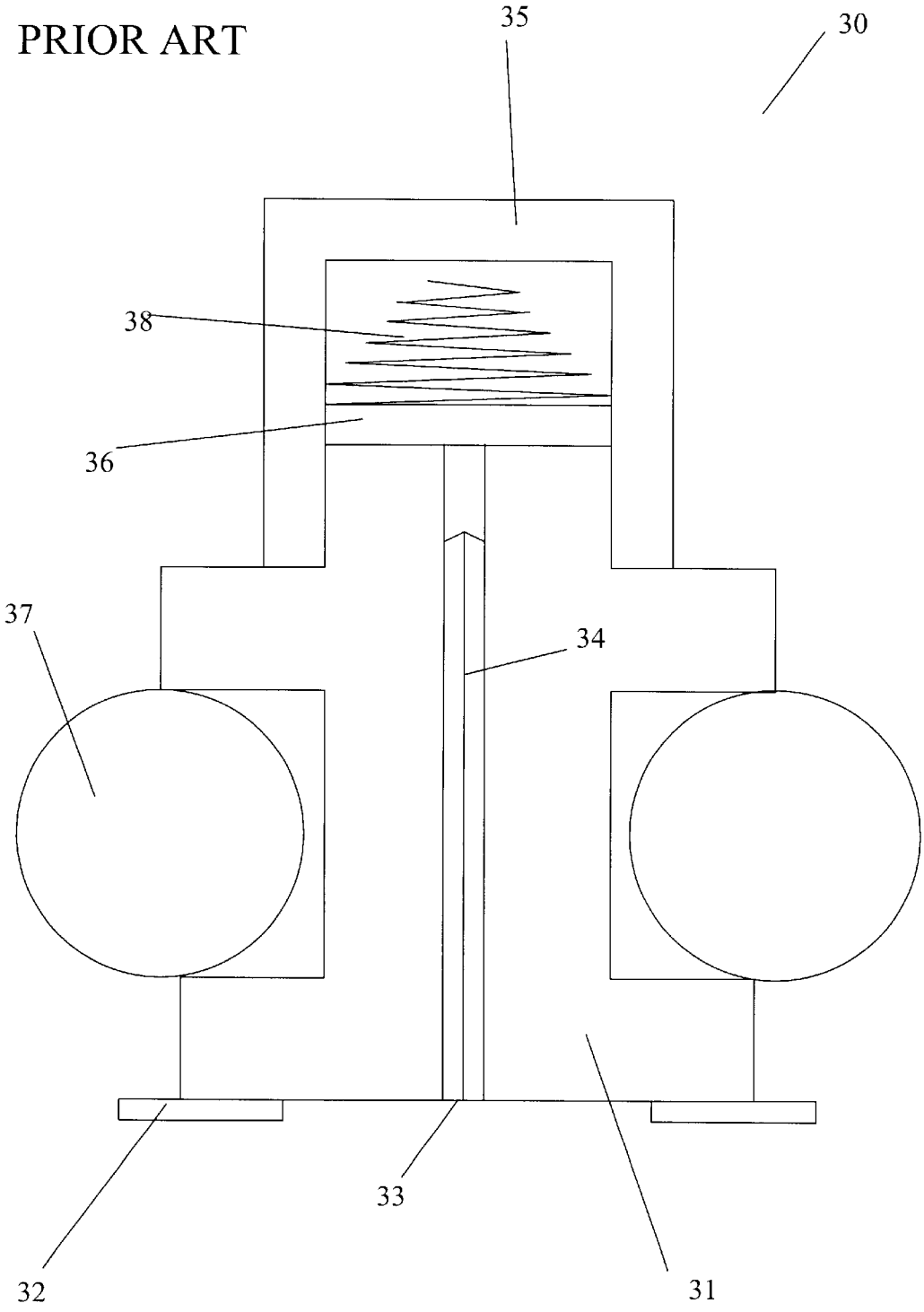
Fig. 5 PRIOR ART
FIG. 5 shows a check valve as known in the prior art.

Referring also to FIGS. 3 and 4, in a method of the present invention, oil enters the rotor (1) from the camshaft, and the supply reed valve (12) opens up into cavity (16) of the spacer (15) in step (100). Make-up oil from the spool valve preferably also enters the cavity (16) in step (105).

Oil from step (100) and step (105) travels through the worm trail (17) in the spacer (15) in step (110). The trail from step (100) through step (110) is shown in FIG. 3 as a dashed line (101). At this point, oil can travel from the worm trail (17) to either of the worm trails (18) and (19). The route of the oil which travels to worm trail (18) is shown as a dotted line (102) in FIG. 3. The route of the oil which travels to worm trail (19) is shown as a dashed and dotted line (103) in FIG. 3.

Oil from the worm trails (18) and (19) enters the hole (4) and (5), respectively for phasing in step (130). The oil then travels out to the first fluid chamber and the second fluid chamber in step (140).

The present invention prevents the phaser from rotating, and works at a wide range of engine oil pressures, preferably from 6–7 psi to 80–90 psi. Prior art valves act predominantly with engine oil pressure, which makes the phasers slow. Other prior art phasers use pressure developed from oscillation inertia, which allows a faster responding phaser, but the check valves that maintain that pressure are relatively slower in response to the reed valve style. In contrast, reed valves of the present invention respond more rapidly than the check valves of the prior art.

Some additional advantages of the reed valves of the present invention include quicker release, less manufacturing expense, less parts, and better wear than the check valves known in the prior art.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A check valve system for a phaser comprising:

a) a reed plate that includes:

i) a supply reed valve comprising a base and a first extension and a second extension, wherein the first extension and the second extension extend from the base and are located apart from each other, wherein the supply reed valve opens up into a cavity to receive oil from a rotor;

ii) a first chamber reed valve; and iii) a second chamber reed valve;

wherein the first chamber reed valve and the second chamber reed valve each comprises a base covering an entrance to at least one passageway leading to at least one chamber of a vane and a first extension and a second extension spaced apart from each other and extending from the base; and b) a network of worm trails, having a primary end, and two secondary ends, wherein the primary end of the network is connected to the cavity;

wherein the first chamber reed valve and the second chamber reed valve are each connected to one of the secondary ends of the network of worm trails; and wherein the first chamber reed valve and the second chamber reed valve receive oil from the network of worm trails.

2. The check valve of claim 1, wherein the reed plate is approximately 0.3 mm thick.

3. The check valve of claim 1, wherein the worm trails are approximately 4 mm deep.

4. A phaser for an internal combustion engine, comprising:

a) a rotor comprising:

i) means for receiving oil from a camshaft;

ii) a plurality of passageways to a plurality of fluid chambers; and iii) two recesses, wherein each recess overlaps with at least one passageway;

b) a reed plate located stacked and concentric to the rotor, comprising;

i) a supply reed valve comprising a base and a first extension and a second extension, wherein the first extension and the second extension extend from the base and are located apart from each other, wherein the supply reed valve opens up into a cavity to receive oil from the rotor;

ii) a first chamber reed valve; and iii) a second chamber reed valve;

wherein the first chamber reed valve and the second chamber reed valve each comprises a base covering an entrance to at least one passageway leading to at least one chamber of a vane and a first extension and a second extension spaced apart from each other and extending from the base; and c) a spacer located stacked and concentric to the reed plate, comprising a network of worm trails, having a primary end, and two secondary ends, wherein the primary end of the network is connected to the cavity;

wherein the first chamber reed valve and the second chamber reed valve are each connected to one of the secondary ends of the network of worm trails; and wherein the first chamber reed valve and the second chamber reed valve receive oil from the network of worm trails.

5. The phaser of claim 4, wherein the reed plate is approximately 0.3 mm thick.

6. The phaser of claim 4, wherein the worm trails are approximately 4 mm deep.

7. The phaser of claim 4, wherein the spacer is approximately 10 to 15 mm thick.

* * * * *